US006260548B1

(12) United States Patent
Wade

(10) Patent No.: US 6,260,548 B1
(45) Date of Patent: Jul. 17, 2001

(54) GAS OPERATED FIREPLACE MODULE

(75) Inventor: Philip A. Wade, Surrey (CA)

(73) Assignee: Wade Holdings, Inc., Winchester, KY (US)

( * ) Notice: Subject to any disclaimer, the term of this patent is extended or adjusted under 35 U.S.C. 154(b) by 0 days.

(21) Appl. No.: 09/256,545

(22) Filed: Feb. 24, 1999

Related U.S. Application Data

(60) Provisional application No. 60/075,734, filed on Feb. 24, 1998.

(51) Int. Cl.[7] ..... F24C 3/00

(52) U.S. Cl. ..... 126/512; 126/92 R; 431/125

(58) Field of Search ..... 126/512, 544, 126/549, 547, 552, 500, 92 R, 92 AC; 431/125, 126

(56) References Cited

U.S. PATENT DOCUMENTS

| | | | | |
|---|---|---|---|---|
| 852,679 | * | 5/1907 | Richards | 431/125 |
| 2,084,566 | * | 6/1937 | Warfield | 126/92 R |
| 2,302,796 | * | 11/1942 | Oyster | 126/92 R |
| 3,042,109 | | 7/1962 | Peterson | 126/512 |
| 3,362,395 | * | 1/1968 | Peterson | 126/512 |
| 4,043,312 | | 8/1977 | Kern | 431/125 |
| 4,276,869 | | 7/1981 | Kern | 126/92 AC |
| 4,544,347 | | 10/1985 | Herbert | 431/125 |
| 4,582,478 | | 4/1986 | Hilker | 431/125 |
| 4,602,609 | | 7/1986 | Wright | 126/92 AC |
| 4,726,351 | | 2/1988 | Whittaker et al. | 126/512 |
| 4,828,485 | | 5/1989 | Jankowski | 431/125 |
| 4,869,664 | | 9/1989 | Wright et al. | 126/92 AC |
| 4,951,650 | | 8/1990 | Boyes et al. | 126/92 R |
| 4,976,253 | | 12/1990 | Beal et al. | 126/512 |
| 5,000,162 | | 3/1991 | Shimek et al. | 126/512 |
| 5,092,313 | | 3/1992 | Blackburn et al. | 126/512 |
| 5,328,356 | | 7/1994 | Hawkinson | 126/512 |
| 5,647,342 | | 7/1997 | Jamieson et al. | 126/512 |

FOREIGN PATENT DOCUMENTS 2 035 545 * 6/1980 (GB) .

* cited by examiner

*Primary Examiner*—Ira S. Lazarus
*Assistant Examiner*—Josiah C. Cocks
(74) *Attorney, Agent, or Firm*—Frost Brown Todd LLC

(57) ABSTRACT

An improved gas operated fireplace module is provided having a ceramic support base with a plurality of irregularly-shaped and spaced protruberants on the upper surface of the base. Ceramic fuel logs are disposed on the upper surface of the ceramic support base and are preferably fixedly connected thereon. A gas burner, which is preferably elongated, is disposed in close proximity to the ceramic support base so that flames emitted therefrom play onto the upper surface of the ceramic support base to interact with the various protruberants and the underside surfaces of the fuel logs. The module may further include a plurality of artificial coals disposed integrally with the ceramic support base and the underside of one or more of the fire logs. The base preferably also includes a plurality of irregularly-shaped secondary combustion openings to provide additional combustion airflow and to randomly redirect flames for a more naturally appearing flame picture.

6 Claims, 6 Drawing Sheets

GAS OPERATED FIREPLACE MODULE

This application claims priority from U.S. Provisional Patent Application Serial No. 60/075,734, filed on Feb. 24, 1998, the disclosure of which is incorporated herein by reference.

TECHNICAL FIELD

This invention relates generally to a gas burner assembly, and, more particularly to a modular gas burning assembly that utilizes artificial logs to provide a decorative and realistic simulation of a real solid fuel fire.

BACKGROUND OF THE INVENTION

To simulate the appearance of burning wood logs, it is well known in the art to utilize fireplace modules that burn gas and that utilize artificial log assemblies. The artificial log assemblies typically include several artificial logs of a ceramic or other refractory material designed to simulate the appearance of wood logs. A gas burner supplies a flammable gas underneath the artificial logs. The gas is burned to produce a flame in the vicinity of the logs. The fireplace can include a tank or reservoir for holding the flammable gas or can be connected to a remote gas source. Fireplaces utilizing artificial log assemblies provide heat and a pleasing appearance of a wood fire, while avoiding the inconvenience and associated lack of cleanliness which results from the loading of wood into and removal of ashes from conventional wood burning fireplaces.

It is desirable in the design and construction of gas log fireplaces to provide artificial logs that look like real wood logs and to provide gas flames which closely simulate the flames produced by burning wood so that an overall effect of burning wood is produced. It is known in the art that both the size and color of the flame, as well as the position of the flame relative to the logs, are important in producing a realistic simulation of a wood burning fire. Manufacturers of prior art gas log assemblies have sought to provide gas log fireplaces that provide high heat output, high combustion efficiency, with minimal soot and noxious gases produced by combustion, at a minimal cost.

Despite advances made in the art over the years, prior art gas log fireplaces continue to exhibit various disadvantages including an unrealistic appearance, low heat output, low combustion efficiency, maintenance difficulty and excessive complexity.

SUMMARY OF THE INVENTION

Accordingly, it is a primary object of the present invention to provide a gas operated fireplace module that overcomes some of the aforementioned shortcomings exhibited by prior art gas burner fireplace modules. Additional objects, advantages and other novel features of the invention will be set forth in part in the description that follows and in part will become apparent to those skilled in the art upon examination of the following or may be learned with the practice of the invention.

To achieve the foregoing and other objects, and in accordance with one aspect of the present invention, an improved gas burner fireplace module is provided. The module includes a ceramic support base that further includes a plurality of upstanding protuberants disposed thereon. The module further includes at least one ceramic fuel log disposed on the upper surface of the ceramic support base and a gas burner arranged so that flames emitted therefrom play onto the surface of the support base, the logs, and the protuberants. Preferably, the ceramic support base and the underside surfaces of the logs include a plurality of integral "artificial" coals demarcated thereon. Preferably these coals are separated by a plurality of irregularly shaped and non-linear grooves. Preferably, the various components of the module are fixedly connected.

Still other objects of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE PREFERRED EMBODIMENT

Reference will now be made in detail to the present preferred embodiment of the invention, an example of which is illustrated in the accompanying drawings, wherein like numerals indicate the same elements throughout the views.

Figure 1:
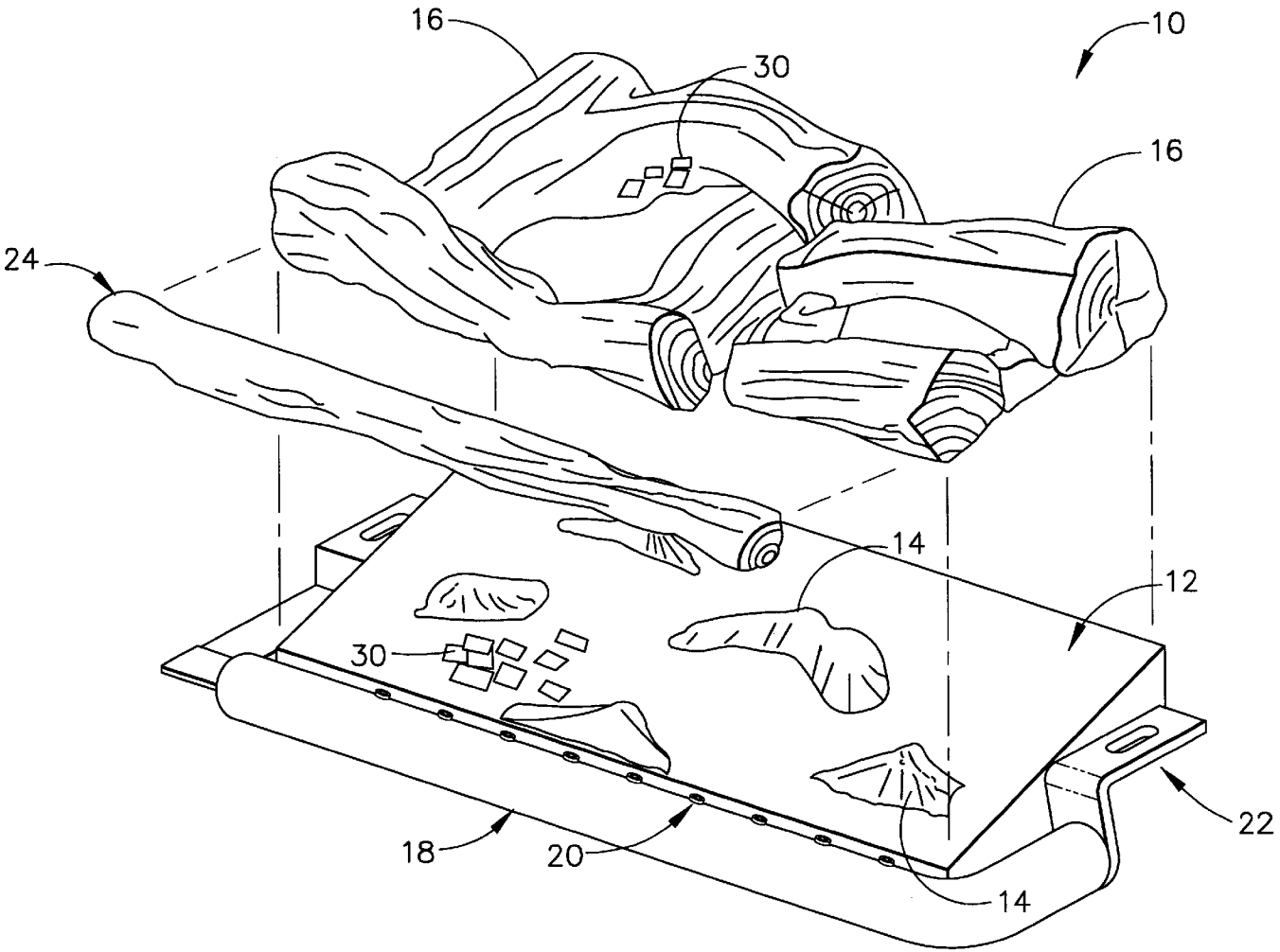
FIG. 1 is an exploded perspective view of the gas operated fireplace module of the present invention.

Referring now to the drawings, FIG. 1 shows the gas operated fireplace module of the present invention generally designated by the numeral 10. The fireplace module 10 includes a support base 12 that has a plurality of upstanding protruberants 14 thereon. Preferably, the support base is rectangular in shape and is of a relatively lower height towards its front and of a relatively higher height towards its back. For example, the support base 12 may be substantially wedge-shaped in cross-section. The base 12 is preferably formed of a lightweight ceramic material, such as fired and/or molded ceramic fibers.

The fireplace module 10 further includes one or more ceramic fuel logs 16 which are disposed on an upper surface of the ceramic support base 12. The protruberants 14 are preferably positioned in and contoured in shape in such a way that, in combination with the underside surface profile of the fuel log 16, form tunnels or galleries for the deflection and guiding of the oncoming flames. As seen in the Figures, proturberants are preferably irregularly-shaped and disposed in a somewhat random pattern on base 12 so as to simulate authentic embers and wood pieces associated with conventional fires.

The fireplace module 10 further includes a preferably elongated gas burner 18 that is disposed in proximity with the ceramic support base 12. Preferably, the gas burner is metallic and substantially tubular. Further, gas burner 18 preferably includes multiple gas apertures 20 which are substantially uniformly spaced along the length of the burner 18 when ignited, a row of flames is emitted from the burner at the various gas apertures 20.

Figure 2:
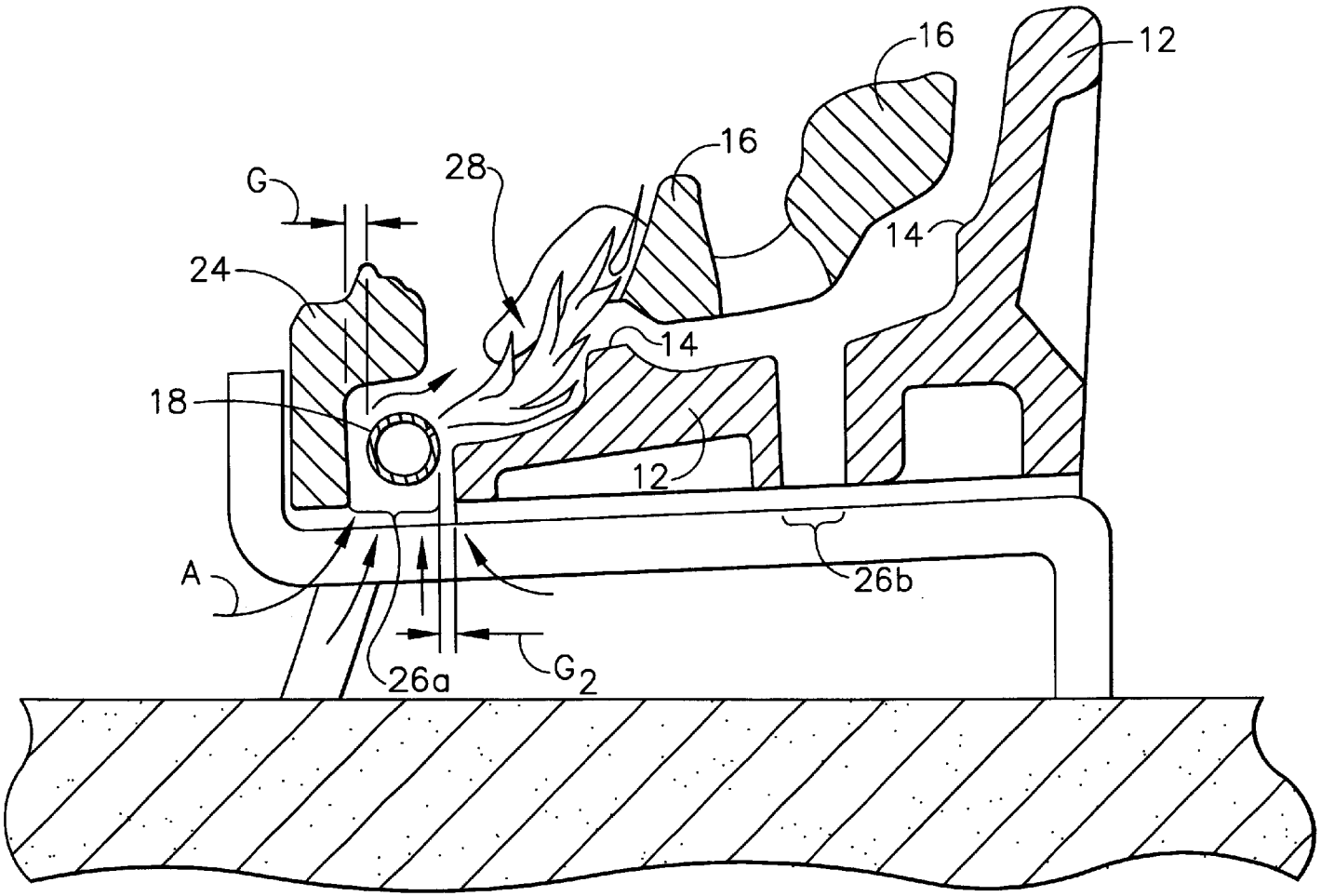
FIG. 2 is a cross-sectional side view thereof showing the initial flame position.

Preferably, the module 10 further includes a molded ceramic fiber burner cover 24 which is disposed substantially in front of a burner 18 so as to at least partially obscure the gas burner 20 from an observer's view while module 10 is ignited and in operation. In order to provide a more aesthetically pleasing appearance, burner cover 24 may be formed to resemble either a log, ashes, or embers or any combination thereof. In addition to being of a size and position to hide the burner 18 from view, the burner cover's 24 distance from the gas burner 18 provides a gap which controls the amount of combustion air circulating about burner 18 to feed the resultant flame during burning. As best seen in FIG. 2, this gap 26*a* may be increased or decreased to guide the flame more horizontally or vertically as desired. Preferably, cover 24 is fixedly disposed at a predetermined gap 26*a* from burner 18. Additionally, as shown in FIG. 2, direction arrows A indicate air flow through gap 26*a* in and around burner 18 which feeds flame 28.

As shown in FIG. 1, the ceramic support base 12 may include an upper surface that has a plurality of artificial coals 30 disposed integrally thereon. Preferably, the artificial coals 30 are separated and demarcated by a plurality of irregularly-shaped and nonlinear grooves. Advantageously, these irregularly-shaped grooves help to channel the flame emitted from the burner 18 in a more random pattern as compared to prior art devices so as to result in a more realistic appearing fire. These artificial coals 30 may be substantially co-planar and of a lesser height than the upstanding protruberants 14. Additionally, logs 16 may be provided with downwardly extending projections which further serve to randomize the flame picture. Further, the fuel logs 16 may also include a plurality of artificial coals 30 disposed on a underside surface of the logs 16. Similarly, the artificial coals 30 on the underside of the log 16, as shown in FIG. 1, may be separated and demarcated by a plurality of nonlinear grooves to further channel the flame emitted from the burner 18 in a more random and realistic fashion. Brackets 22 may be provided for mounting module 10 within a fireplace.

The ceramic fiber material is preferably sufficiently refractory to withstand surface temperatures of at least 800° C. without distortion, shrinkage or thermal stress damage.

The various ceramic components of the gas operated fireplace module 10 may be preshaped. For example, ceramic support base 12 may be preshaped by forming the upstanding protruberants 14 and artificial coals 30 before firing to a temperature appropriate to the particular ceramic composition to achieve the required final properties. Another method could be to machine the surfaces of the support base 12 to the required configuration. The various ceramic components of the module 10 may be colored by either coating them with ceramic surface colorants or by incorporating a coloring agent in the body formation.

Reference is now made to FIGS. 2–6, wherein the gas operated fireplace module 10 and its various subcomponents are shown in cross-section. These Figures illustrate how the ignited gas flame 28 travels from the apertures 20 of the burner 18 off of the various control features such as the artificial coals 30, protruberants 14 and logs 16 in order to achieve a realistic flame picture. As should be appreciated, depending on the specific arrangement of the protruberants 14, coals 30, and logs 16, the cross-sections shown in FIGS. 2–6 may be taken at substantially any position along the module 10. The cross-section configurations shown are exemplary only as the module 10 is not of uniform cross-section along its length and the various cross-section Figures are shown to illustrate how the various control features may combine to alter the overall flame profile at various points along the length of the module 10.

FIG. 2 shows a cross-sectional view of the fireplace module 10 and depicts the flame position 28 just after ignition. As can be seen, combustion air flows in and around burner 18 through inlet 26*a*. Protruberants 14 on base 20 serve to deflect the flame 28 up through an opening in log 16. As described previously, gaps G1 and G2 may be varied or permanently determined based on the placement of cover 24, base 12 and burner 18 so as to optimize the size of inlet 26*a* depending on airflow requirements (see direction arrows A).

Figure 3:
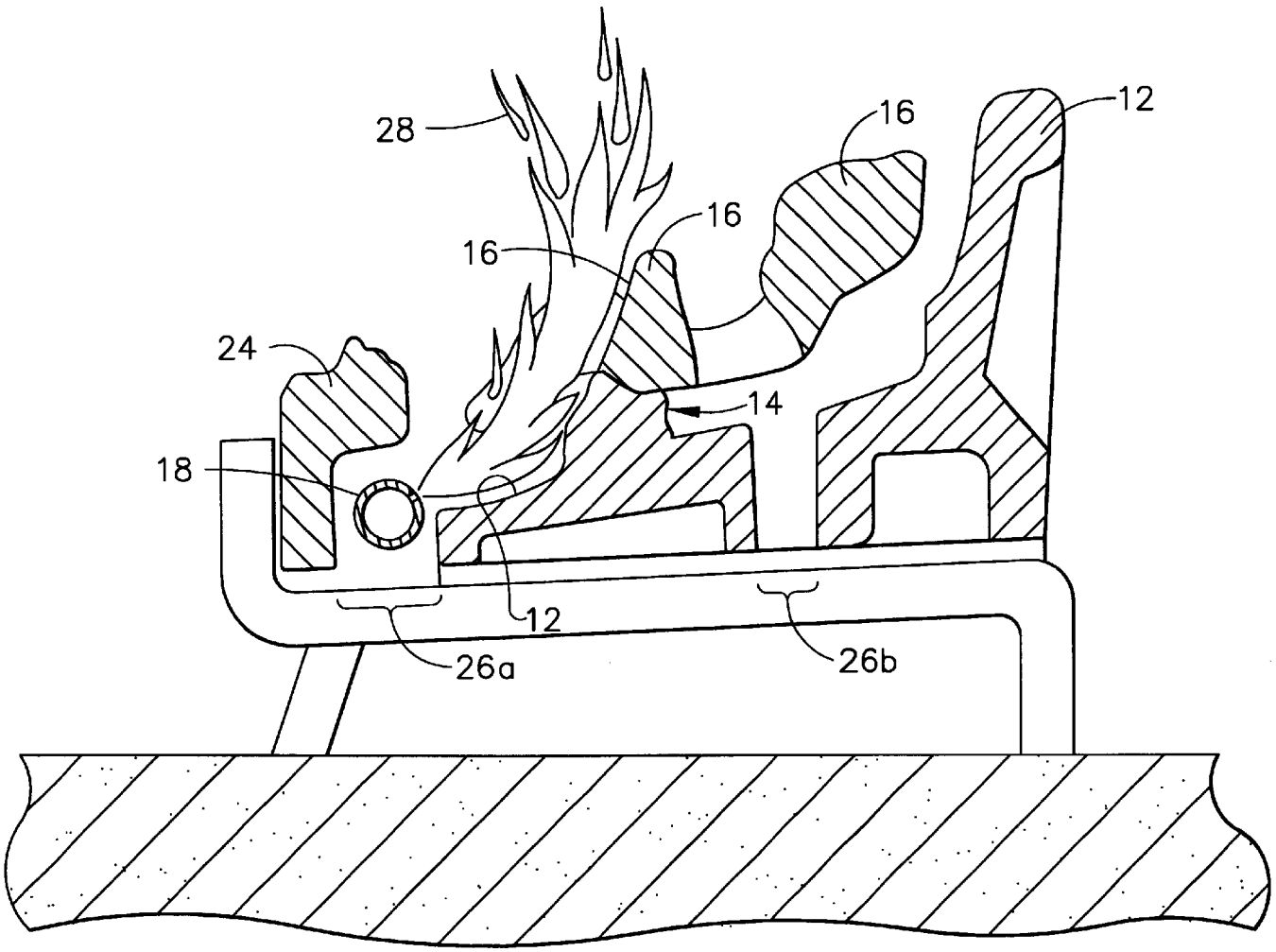
FIG. 3 is a cross-sectional side view thereof showing the flame being directed towards the front of the module.

As shown in FIG. 3, at various points along the interface of log 16 and base 12, the upstanding protruberants 14 abut log 16 so as to substantially block a portion of flame 28. As a result, such a flame 28 travels upwardly towards the front vertical surface of the logs 16.

Figure 4:
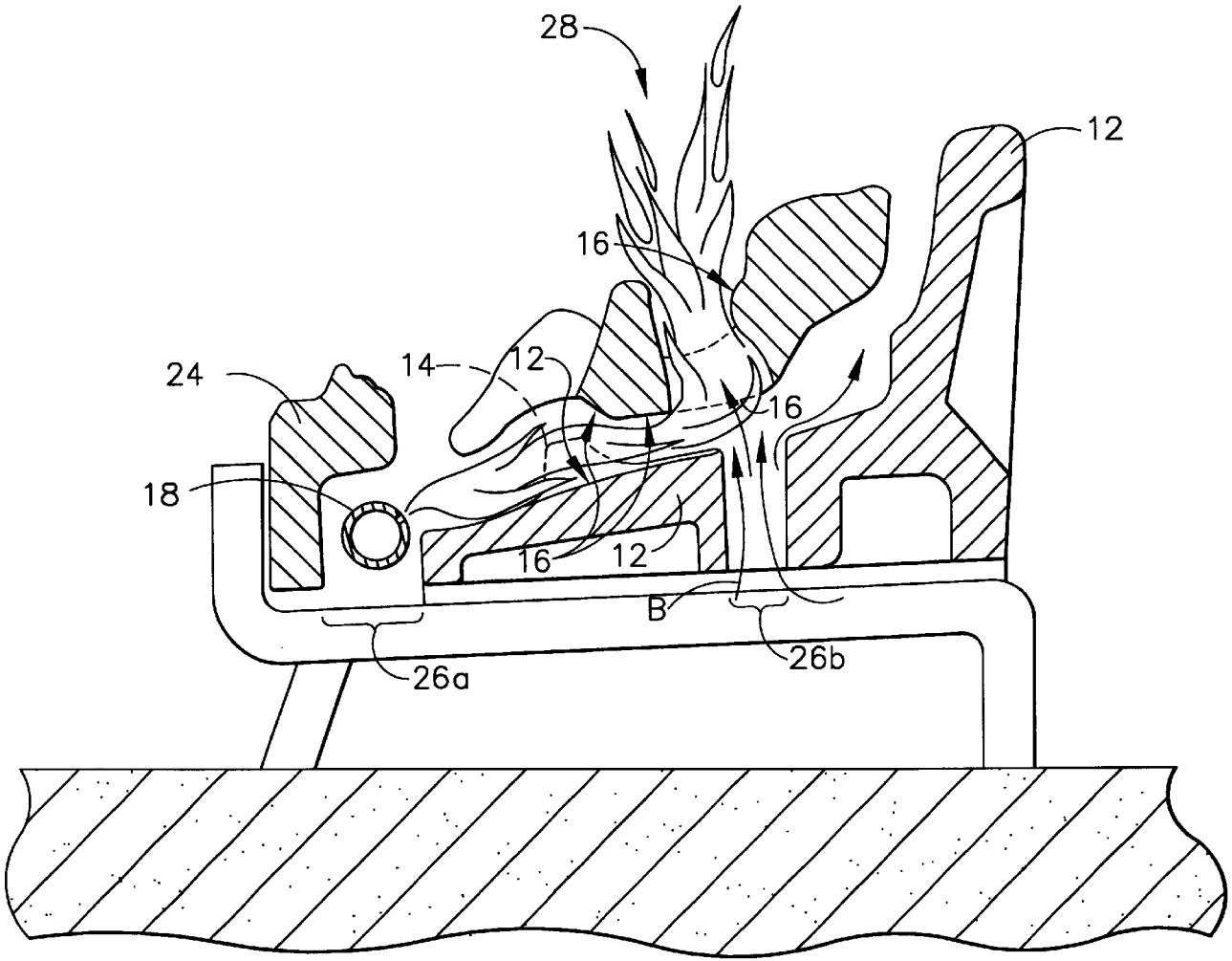
FIG. 4 is a cross-sectional side view thereof showing the flame being directed to the mid-section of the module and the introduction of additional secondary combustion air through a secondary air inlet.

As shown in FIG. 4, one or more additional combustion air inlets 26*b* may also be incorporated into ceramic support base 12. These additional inlets 26*b* are preferably a series of irregularly-shaped and positioned holes that run from the underside completely through the top surface of the ceramic support base 12. These inlets 26*b* advantageously provide additional airflow (see direction arrows B) beneficially increasing resultant combustion performance. Additionally, the airflow through the secondary inlets 26*b* also may act as a complete or partial barrier to oncoming flames even though a passage may otherwise be open at that particular point along the width of the module 10. As shown in FIG. 4, the additional airflow traveling through inlet 26*b* redirects flame 28 by interfering with the flow of the flame 28. As should be appreciated, this secondary air source which sometimes redirects flame 28 being emitted from the burner 18 results in a more naturally appearing and realistic flame picture.

Figure 5:
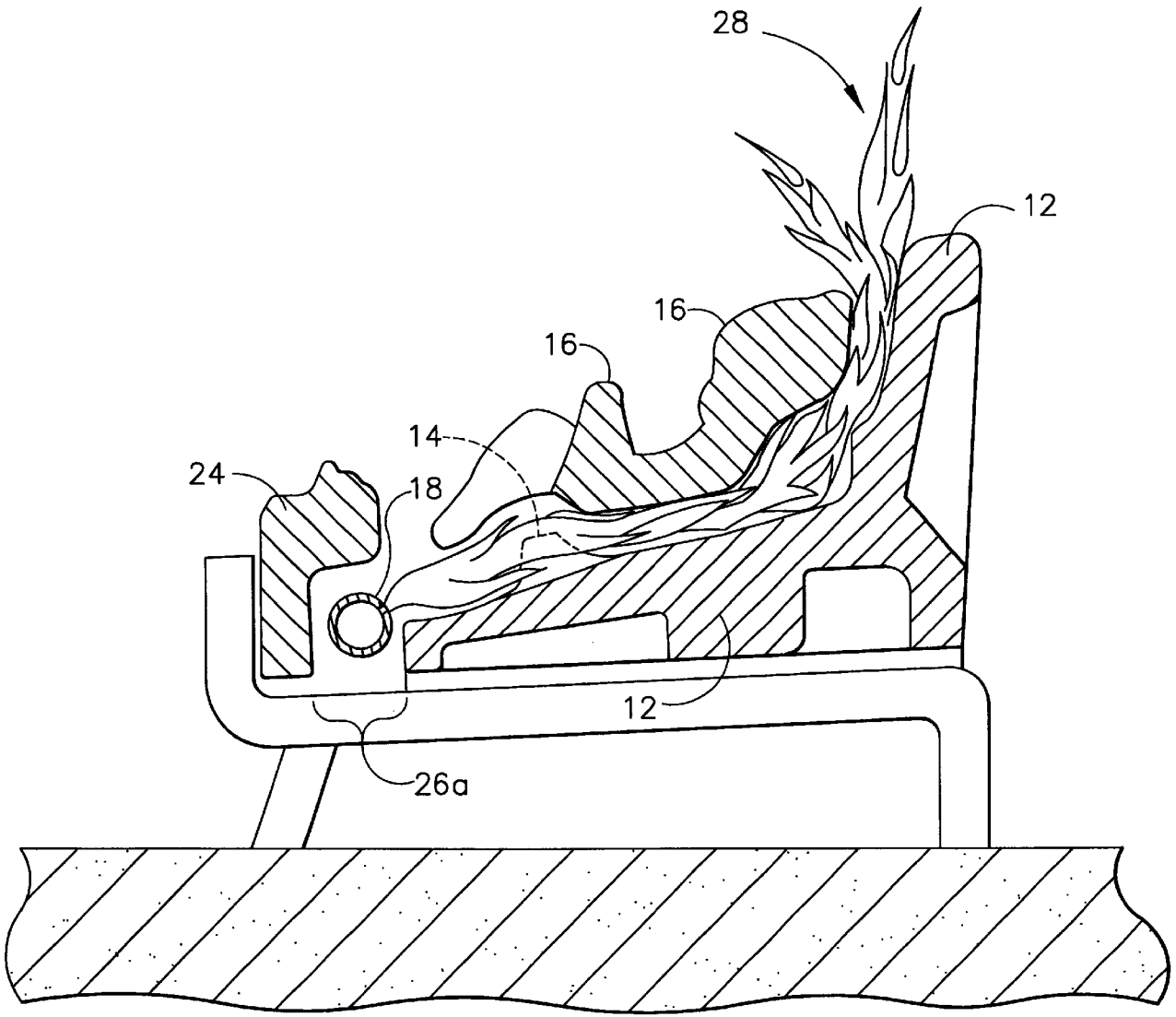
FIG. 5 is a cross-sectional side view thereof showing the flame being directed towards the rear of the module.
Figure 6:
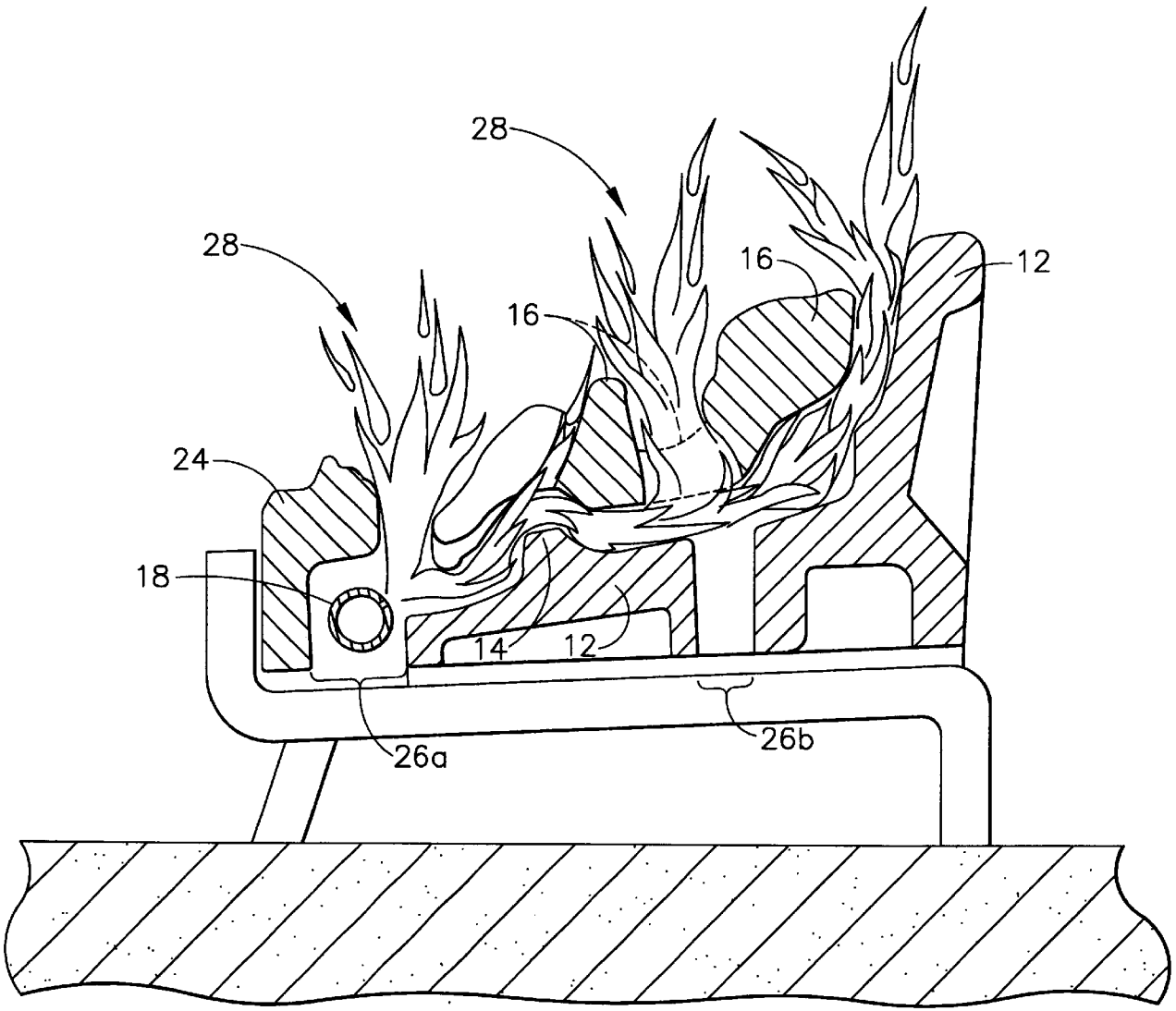
FIG. 6 is a cross-sectional side view thereof showing the combined flame profile that results from the various flame control features of the present invention.

FIG. 5 shows flame 28 being directed obliquely towards the rear of the module 10 under a section of log 16 where there is no aperture. FIG. 6 indicates the combined flame profile that results from the flame 28 impinging against and flowing around the various flame control features (log 16, protruberants 14, support base 12 and artificial coal 30) described herein. As can be seen in FIG. 6, the combination of the various control features result in the relatively complex flame profile 28 without the need of linear and parallel flow channels or multiple burners. Advantageously, the various surfaces of the ceramic components, when in impinged by flame 28, undergo an increase in surface temperature until they are incandescent and "glow" thereby further adding to the realism of the overall flame picture.

Before a newly designed gas burner appliance may be installed in a home, certain safety standards must be adhered to and new gas appliances are subjected to vigorous testing. For example, certain standards cover general construction and assembly of gas devices and require that parts that are not permanently secured should be designed so that they cannot be incorrectly assembled or improperly located when being removed or replaced during cleaning and servicing. Obviously, this requirement is necessary given the fact that performance of the gas burning appliance will vary greatly when components are not located in their optimal or originally designed and tested locations. For example, incorrectly located log placement may greatly impact combustion performance. It is common for prior art gas operated fireplace modules to include separate log components that are packaged separately from the support base or other components of the module. As a result, one part of a field installer's responsibilities during installation of such an appliance is to properly assemble the "log set" into the unit using factory supplied instructions. This operation can become, if performed incorrectly, a major safety issue. Should the installer or eventual user fail to follow installation instructions precisely, hazardous combustion products may result. However, this is increasingly likely given that many factory service recommendations require cleaning of internal components on an annual basis which generally requires some disassembly. Should the service or maintenance instructions be misplaced, improper reassembly may occur.

According to an important aspect of the present invention, the various parts of the module may be connected to form a single modular unit that may be easily inserted into and removed from an appliance having a single natural gas or propane line for connecting to the burner 18.

The various components of the module 10 may be fixedly connected by any suitable means such as by bonding or any other suitable method as known in the art. In addition to eliminating some of the potential for improper assembly as detailed above, the field installation time and amount of required expertise is also reduced due to the module 10 being factory preassembled. Another advantage of providing such a modular or preassembled unit is that a homeowner may be able to purchase an approved retrofit kit that might be simply fitted into existing gas appliance structures without having to replace an entire unit.

The gas operated fireplace module 10 of the present invention, is also mechanically much simpler than most of the prior art assemblies. Many prior art assemblies provide a flame picture that is achieved through the use of many separate gas burners, quite often complex systems, which are incorporated in combination with a log grouping. The present invention may be a complete burner/log assembly requiring no secondary "on site" assembly as the various components may be fixedly connected at the "factory."

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the present invention and its practical application to thereby enable one of ordinary skill in the art to best utilize the invention in various embodiments and with various modifications as are suited to the particular use contemplated.

What is claimed is:

1. A gas operated fireplace module, said module comprising:

(a) a ceramic support base having a plurality of protuberants on an upper surface thereof, said ceramic support base being substantially devoid of substantially parallel channels, said upper surface of said ceramic support base further comprising a plurality of Artificial coals disposed integrally thereon, said artificial coals being demarcated by a plurality of non-linear grooves;

(b) one or more ceramic fuel logs, said one or more fuel logs being disposed on said upper surface of said ceramic support base; and (c) a gas burner, said gas burner being disposed in close proximity to said ceramic support base, said gas burner being arranged so that flames emitted therefrom play onto said upper surface of said ceramic support base to interact with said plurality of protuberants and an underside surface of said one or more ceramic fuel logs.

2. The gas operated fireplace module of claim 1, wherein said gas burner is substantially elongated.

3. The gas operated fireplace module of claim 2, wherein said gas burner comprises a plurality of gas apertures disposed along its length.

4. The gas operated fireplace module of claim 3, wherein said module further comprises a ceramic burner cover, said burner cover being disposed substantially in front of said burner so as to at least partially obscure said gas burner from view during combustion.

5. The gas operated fireplace module of claim 4, wherein said underside surface of said one or more ceramic logs comprises one or more downwardly depending projections extending therefrom.

6. The gas operated fireplace module of claim 1, wherein said underside surface of said one or more ceramic fuel logs includes a plurality of artificial coals disposed thereon, said artificial coals being demarcated by a plurality of non-linear grooves.

* * * * *